US008469783B2

(12) United States Patent
Juslin et al.

(10) Patent No.: US 8,469,783 B2
(45) Date of Patent: Jun. 25, 2013

(54) SUPPLY AIR TERMINAL DEVICE AND METHOD FOR REGULATING THE AIRFLOW RATE

(75) Inventors: Vesa Juslin, Uusikylä (FI); Mikko Pulkkinen, Kausala (FI); Heimo Ulmanen, Kausala (FI); Reijo Villikka, Kausala (FI)

(73) Assignee: Halton Oy, Kausala (FI)

( * ) Notice: Subject to any disclaimer, the term of this patent is extended or adjusted under 35 U.S.C. 154(b) by 923 days.

(21) Appl. No.: 11/621,147

(22) Filed: Jan. 9, 2007

(65) Prior Publication Data

US 2007/0164124 A1 Jul. 19, 2007

(30) Foreign Application Priority Data

Jan. 16, 2006 (FI) ..... 20060035

(51) Int. Cl.
*F24F 7/00* (2006.01)
*F24F 13/04* (2006.01)

(52) U.S. Cl.
USPC ..... 454/237; 454/261

(58) Field of Classification Search
USPC ..... 454/237, 233; 62/426, 407; 165/53, 165/123
See application file for complete search history.

(56) References Cited

U.S. PATENT DOCUMENTS

| | | | | |
|---|---|---|---|---|
| 3,193,000 | A | 7/1965 | Bressoud | |
| 3,611,908 | A | 10/1971 | Spoormaker | |
| 4,397,223 | A | 8/1983 | Maxson | |
| 4,448,111 | A * | 5/1984 | Doherty | 454/256 |
| 4,562,883 | A * | 1/1986 | Janeke | 165/57 |
| 5,556,335 | A | 9/1996 | Holyoake | |
| 6,370,907 | B1 * | 4/2002 | Sekiguchi et al. | 62/426 |
| 7,000,688 | B2 | 2/2006 | Horttanainen et al. | |

FOREIGN PATENT DOCUMENTS

| | | |
|---|---|---|
| DE | 2 033 195 | 1/1972 |
| DE | 28 20 115 | 11/1979 |
| DE | 29 44 291 | 5/1981 |
| DE | 34 08 569 A1 | 3/1984 |
| DE | 34 08 569 A1 | 2/1986 |
| EP | 0 924 475 | 6/1999 |
| EP | 0 967 444 A2 | 12/1999 |
| EP | 0 967 444 B1 | 12/1999 |

(Continued)

*Primary Examiner* — Steven B McAllister
*Assistant Examiner* — Helena Kosanovic
(74) *Attorney, Agent, or Firm* — Cozen O'Connor

(57) ABSTRACT

The invention concerns a supply air terminal device (10) and a method for regulating the airflow rate. The supply air terminal device (10) comprises a heat exchanger (11), with which a circulated airflow ($L_2$) conducted from a room can be either cooled or heated. The supply air terminal device (10) comprises a mixing chamber (12), into which mixing chamber (12) the air chamber's (15) nozzles (16$a_1$, 16$a_2$ . . . 16$a_n$) or a flow gap (16) open to conduct a primary airflow ($L_1$) into the mixing chamber (12), whereby the primary airflow ($L_1$) from the nozzles (16$a_1$, 16$a_2$ . . . 16$a_n$) or through the flow gap (16) as a flow ($Q_s$) will induce a circulated airflow ($L_2$) from the room (H) to flow through the heat exchanger (11) into the mixing chamber (12). The combined airflow ($L_1$+$L_2$) is conducted into the room (H). The supply air terminal device (10) comprises a regulator (100) bypassing the nozzles (16$a_1$, 16$a_2$ . . . 16$a_n$) or the flow gap (16) to regulate an airflow ($Q_3$) passing through the regulator (100), with which, depending on the purpose of use of the room, it is possible to regulate the total airflow ($\Sigma Q$) of the fresh primary air ($Q_3$+$Q_s$) supplied from outside the supply air terminal device.

9 Claims, 7 Drawing Sheets

FOREIGN PATENT DOCUMENTS

| | | | |
|---|---|---|---|
| EP | 1 130 331 | | 3/2000 |
| EP | 1130331 | B1 | 2/2001 |
| FI | 20002589 | | 5/2002 |
| FI | 20000813 | | 3/2003 |
| GB | 896722 | | 5/1962 |
| GB | 2 144 212 | | 2/1985 |
| GB | 2 144 212 | A | 2/1985 |
| GB | 2 364 117 | | 1/2002 |
| GB | 2413378 | A * | 10/2005 |
| JP | 59109743 | | 6/1984 |
| JP | 9014718 | | 1/1997 |
| SE | 516 349 | | 12/2001 |
| SE | 523 292 | | 4/2004 |
| SE | 528 140 | C2 | 9/2006 |

* cited by examiner

SUPPLY AIR TERMINAL DEVICE AND METHOD FOR REGULATING THE AIRFLOW RATE

BACKGROUND OF THE INVENTION

The invention concerns a supply air terminal device and a method for regulating the airflow rate.

Known in the state of the art are supply air terminal device solutions, wherein fresh supply air, that is, primary air, is conducted from outside into a supply air chamber and is made to flow from the supply air chamber through nozzles into a mixing chamber, whereby said airflow conducted from nozzles will induce a circulated airflow, that is, a secondary airflow, from the room to flow through a heat exchanger into a mixing chamber. In the heat exchanger, the circulated airflow is either heated or cooled. From the mixing chamber the fresh supply airflow and the circulated airflow are made to flow combined back into the room space H.

It has been a difficulty in the state-of-the-art solutions how to achieve a sufficiently large airflow rate range with the same device. This problem has been solved in the state-of-the-art solution in such a way that the nozzles have been exchangeable, whereby a device of a certain type has been able to comprise a high number of nozzle series. Depending on the installation, it has hereby been possible to choose the desired nozzle series to be suitable for each installation purpose and airflow rate.

However, it has been another difficulty in the above-mentioned solutions that a certain number of nozzle series has not either been sufficient to implement a sufficiently large airflow rate range for a certain type of device.

BRIEF SUMMARY OF THE INVENTION

This application presents an improvement on the above-mentioned problem. The invention proposes the use of a separate regulator, with the aid of which the desired airflow rate can be regulated. The regulator can be a manual regulating damper or valve or an electrically controlled regulating damper or valve. The supply air chamber comprises nozzles and a separate regulator for regulating the bypass flow of said nozzles and thus for regulating the total flow rate of the fresh primary air brought from outside into the room. The primary air is conducted into a supply air chamber with the aid of a blowing fan along a tube fitting from the outside air. By using the regulator the total flow rate $\Sigma Q$ (l/s) of the device is determined, that is, the sum of primary air rate $Q_s$ (l/s) arriving from the nozzles and the primary air rate $Q_3$ (l/s) made to flow through the regulator. The operating range of the regulator is largest in the supply air system, wherein a constant pressure is maintained in the duct system, for example, by a constant pressure regulator.

A so-called minimum air rate must flow through the nozzles all the time in order to induce the circulated airflow and in this way to achieve a sufficient cooling and heating power. By opening the regulator the total flow rate ($\Sigma Q = Q_3 + Q_s$) can be increased 1 . . . 6 times compared with the minimum.

The supply air terminal device and the method for regulating the airflow rate according to the invention are characterised by the features presented in the claims.

The invention will be described in the following by referring to some advantageous embodiments of the invention, which are shown in the figures of the appended drawings, but the intention is not to restrict the invention to these only.

DETAILED DESCRIPTION OF THE INVENTION

Figure 1A:
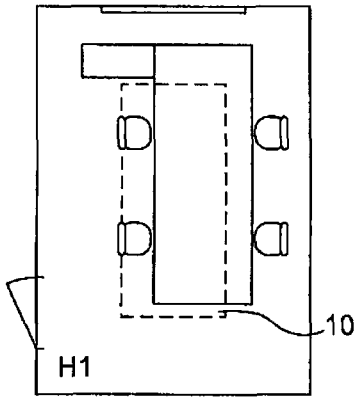
FIG. 1A shows a state-of-the-art operating embodiment wherein the supply air terminal device is fitted in an office room and the need for air to be supplied from the supply air terminal device is within a range of 1.5 . . . 2 liters/square meter.
Figure 1B:
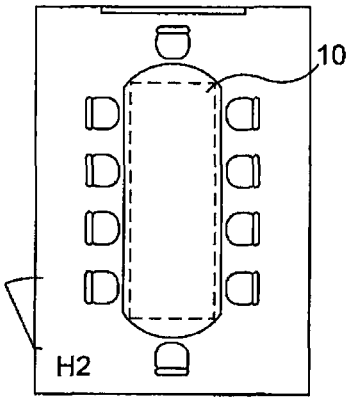
FIG. 1B shows an operating embodiment where the supply air terminal device is fitted in a room used as a room for negotiations.

FIGS. 1A and 1B are illustrative views of two different operating embodiments of the supply air terminal device as regards the state of the art.

In the structure according to FIG. 1A, there is a room H intended as an office room and requiring air from the supply air terminal device within a range of 1.5-2 liters/sq·m.

FIG. 1B shows a room H2 functioning as a negotiation room, whereby the air rate needed in the room is estimated to be within a range of 5-6 liters/sq·m. The devices are ordered ready-made from the factory, whereby the number and size of the nozzles are chosen according to the predetermined purpose of use of the room. Thus, for example, some nozzles are closed by plugs to have the desired air rate.

Such a situation will be problematic where the rooms in FIG. 1A and FIG. 1B will be used for some other purpose. In the case of, for example, a big office house the change may concern several hundred rooms and thus even more supply air terminal devices.

In this application such a solution of the supply air terminal device is formed, where the device solution comprises a separate airflow rate regulator 100, which can be used to set the desired total airflow ΣQ entering the room by arranging a bypassing circulation for a required part of the airflow through the regulator 100. Thus, the regulator 100 forms a regulating valve or regulating damper, which can be set in advance or afterwards and through which the desired total airflow ΣQ entering the room can be set to correspond with the room's purpose of use. Regulator 100 can be fitted into the connecting supply tube 150 of the supply air chamber or it can be fitted in the supply air chamber 15 proper. The airflow rate $Q_3$, which can be changed progressively by regulator 100 through valve 100, is within a range of 0 . . . 50 l/s, and the air rate $Q_2$ arriving through nozzles 16$a_1$, 16$a_2$ . . . 16$a_n$ is typically within a range of 10 . . . 25 l/s, depending on the required cooling or heating effect, which is a critical magnitude for the operation. The flow ratio $Q_3/Q_s$ between flows $Q_3$ and $Q_s$ can be regulated within a range of 0 . . . 5. The maximum airflow is preferably even 6 times the minimum airflow.

In the method according to the invention, the airflow range at the supply air terminal device 10 can thus be regulated in advance or afterwards from case to case. Such a regulator 100 is preferably used, with which the airflow rate through the regulator can be regulated without steps and advantageously also by remote control. The regulator 100 hereby comprises an actuator 200, with the aid of which the position of the regulator's 100 closing part 102, for example, a valve disc, can be regulated in relation to the valve body. In this manner the opening of the valve is opened and closed and the throttling of the airflow $Q_3$ is increased or reduced. When the regulator is in a fully closing position, there is no bypassing flow through regulator 100 to the outside environment from inside chamber 15 or from the supply tube, but flow is only taking place through nozzles 16$a_1$, 16$a_2$ . . . 16$a_n$ or through flow gap 16 as a flow $Q_s$, and hereby the device's total air rate ΣQ of fresh air supplied from outside is at a minimum. When regulator 100 is in the opposite position, that is, fully open, the maximum airflow $Q_3$ is achieved through regulator 100 and hereby the device's total airflow rate $\Sigma Q=Q_s+Q_3$ is at its maximum.

Figure 2A:
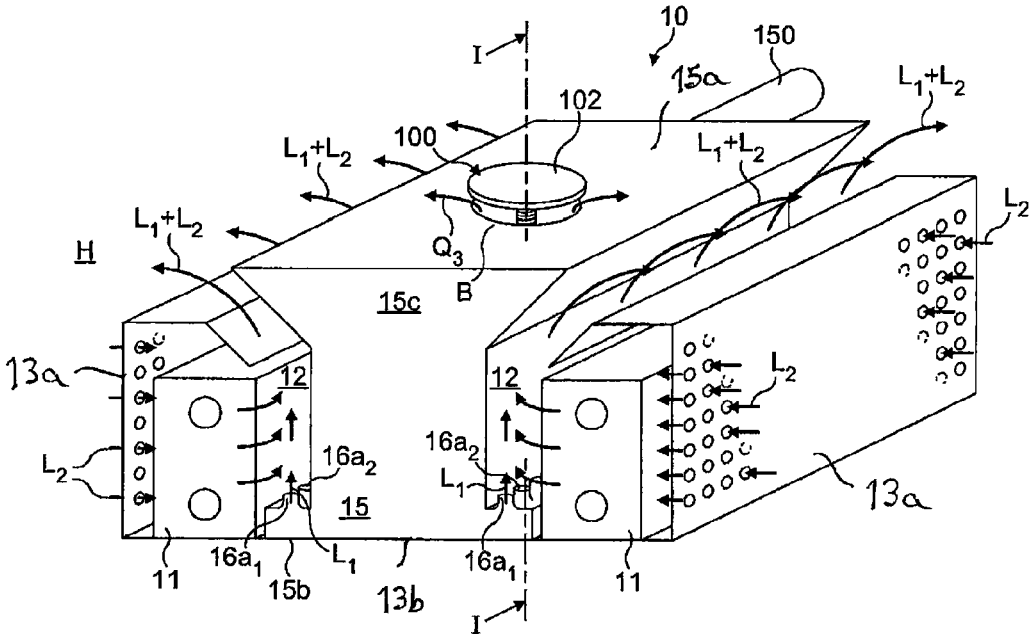
FIG. 2A shows an embodiment of the supply air terminal device where the supply air terminal device is fitted in the ceiling of a room and in which embodiment the supply air terminal device comprises a bottom plate closing the device from below. The presentation is cut open at the end to show the internal components.
Figure 2B:
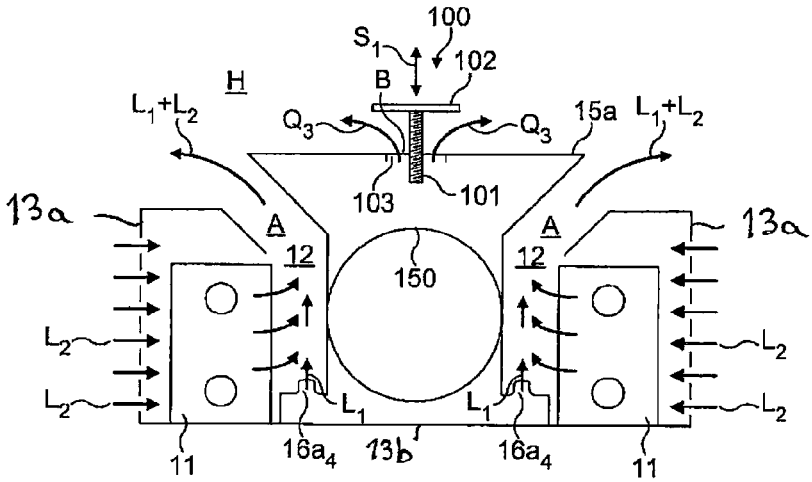
FIG. 2B is a sectional view along line I-I of FIG. 2A.

As is shown in FIGS. 2A, 2B, the supply air terminal device 10 comprises a heat exchanger 11. Using the heat exchanger 11 the circulated airflow conducted from room H, that is, the secondary airflow $L_2$, can be either cooled or heated. A mixing chamber 12 is formed in between the side plate 13*a* and bottom plate 13*b* of body structure 13 and the heat exchanger 11. In one end, the mixing chamber comprises an opening A into the room space H. The air chamber 15 of supply air terminal device 10 also comprises nozzles 16$a_1$, 16$a_2$ . . . 16$a_n$. The figure shows one nozzle; nozzle 16$a_1$. There are preferably several nozzles 16$a_1$, 16$a_2$ . . . side by side in the device.

FIGS. 2A, 2B show an embodiment of the device according to the invention fitted on to the suspended ceiling of the room. The airflow rate of flow $Q_3$ bypassing the nozzles 16$a_1$, 16$a_2$ . . . 16$a_n$ through regulator 100 can be regulated without steps by regulator 100. As is shown in FIGS. 2A, 2B, the supply air terminal device 10 comprises a heat exchanger 11. The circulated airflow conducted from heat exchanger 11 out of room H, that is, the secondary airflow $L_2$, can be either cooled or heated. A mixing chamber 12 is formed in between the side plate 13*a* and the bottom plate 13*b* of body structure 13. The mixing chamber comprises in its one end an opening A into the room space H. The airflow passing through heat exchanger 11 is indicated by arrows $L_2$ and the airflow arriving from nozzles 16$a_1$, 16$a_2$ . . . 16$a_n$ is indicated by arrow $L_1$. The combined airflow $L_1+L_2$ is made to flow obliquely upward from the device. As shown in the figure, regulator 100 is formed by a valve comprising a stem 101 and a valve disc 102. By rotating the valve disc 102 the stem 101 is made to turn in its counter-fastening means 103, preferably in a threaded hole Q, and to close and open flow opening B, as is shown by arrow $S_1$. The airflow rate $Q_3$ made to flow past through valve 100 can be regulated progressively within a range of 0 . . . 50 l/s. The airflow rate $Q_s$ arriving through nozzles 16$a_1$, 16$a_2$ . . . 16$a_n$ is typically within a range of 10 . . . 25 l/s, depending on the required cooling or heating effect, which is a critical magnitude for the operation. $\Sigma Q=Q_3+Q_s$ is within a range of 10-75 l/s. $Q_3/Q_s$ is within a range of 0-5.

Figure 2C:
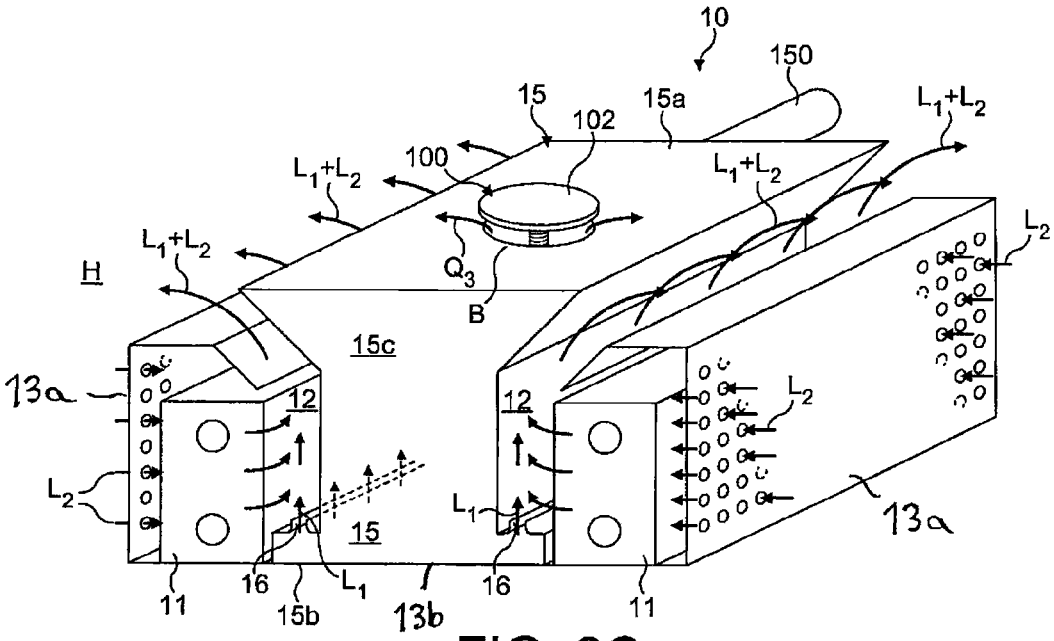
FIG. 2C shows a structure otherwise corresponding with the embodiment shown in FIGS. 2A, 2B, but with one elongate flow gap instead of the nozzles.

FIG. 2C shows a structure otherwise similar to the embodiment shown in FIGS. 2A, 2B, but with an elongate flow gap 16 instead of the nozzles 16$a_1$, 16$a_2$ . . . .

Figure 3A:
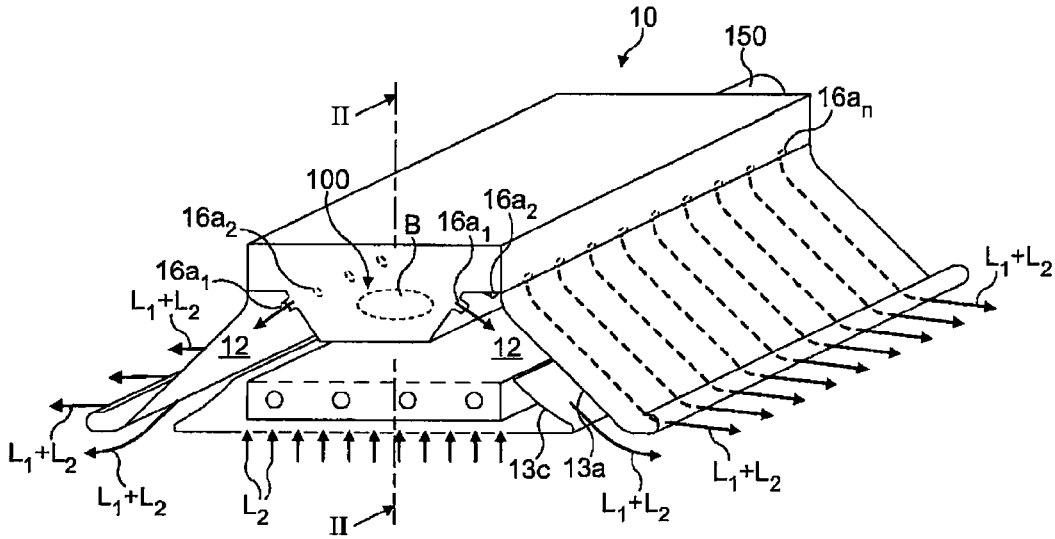
FIG. 3A shows an embodiment of the invention, wherein the supply air terminal device is a structure closed on the sides and on top and fitted to a suspended ceiling to make the airflow horizontally in the direction of the surface of the suspended ceiling. The presentation is cut open at the end to show the internal components.
Figure 3B:
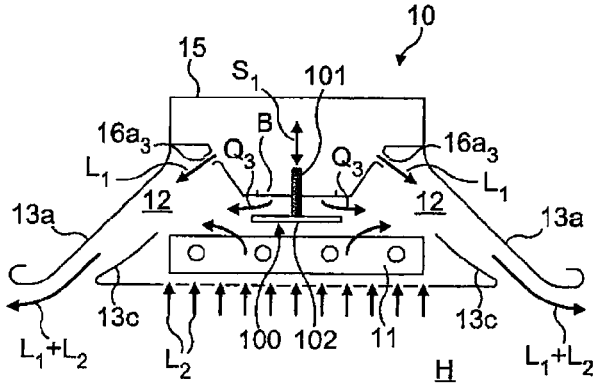
FIG. 3B is a sectional view along line II-II of FIG. 3A.

FIGS. 3A, 3B show another embodiment of the device according to the invention, wherein regulator 100 is fitted in connection with air chamber 15 and to open into a space between heat exchanger 11 and air chamber 15. Regulator 100 comprises a valve disc 102 and a valve stem 101, which can be turned in a threaded hole e in counter-fastening means 103. The bypassing flow $Q_3$ is controlled in this manner. Speaking of bypassing flow regulation, bypassing flow means that flow rate $Q_3$, which is not made to flow through nozzles 16$a_1$, 16$a_2$ . . . 16$a_n$, but said nozzles 16$a_1$, 16$a_2$ . . . 16$a_n$ are hereby bypassed. By regulating the bypassing flow $Q_3$ the total airflow ΣQ of the device is thus regulated, that is, the sum flow $\Sigma Q=Q_3+Q_s$ of air made to flow through the nozzles and the air conducted through the regulator 100.

In the device solution of FIGS. 3A, 3B, the heat exchanger 11, with which the circulated airflow $L_2$ from room H can be cooled or heated, is fitted centrally in the structure below the air chamber 15, and the airflow arriving through nozzles 16$a_1$, 16$a_2$ . . . 16$a_n$ is indicated by arrows $L_1$ in the embodiment shown in the figure, while the circulated airflow of the room H is indicated by arrows $L_2$. The combined airflow $L_1+L_2$ is made to flow to the side from device 10 and preferably in the direction of the suspended ceiling horizontally. The device in the figure is a structure open at the bottom and at the side and closed at the top. In the device solution, when the device is in its place of operation on the suspended ceiling, room air $L_2$ is drawn from below upwards to the heat exchanger 11 and further, induced by the fresh airflow $L_1$ brought from outside and made to flow through nozzles 16$a_1$, 16$a_2$ . . . 16$a_n$, the circulated airflow $L_2$ is conducted into the mixing chamber 12 in between the body plate 13*a* and the guide plate 13*c* and to the side away from the location of the device as a combined airflow $L_1+L_2$.

Figure 3C:
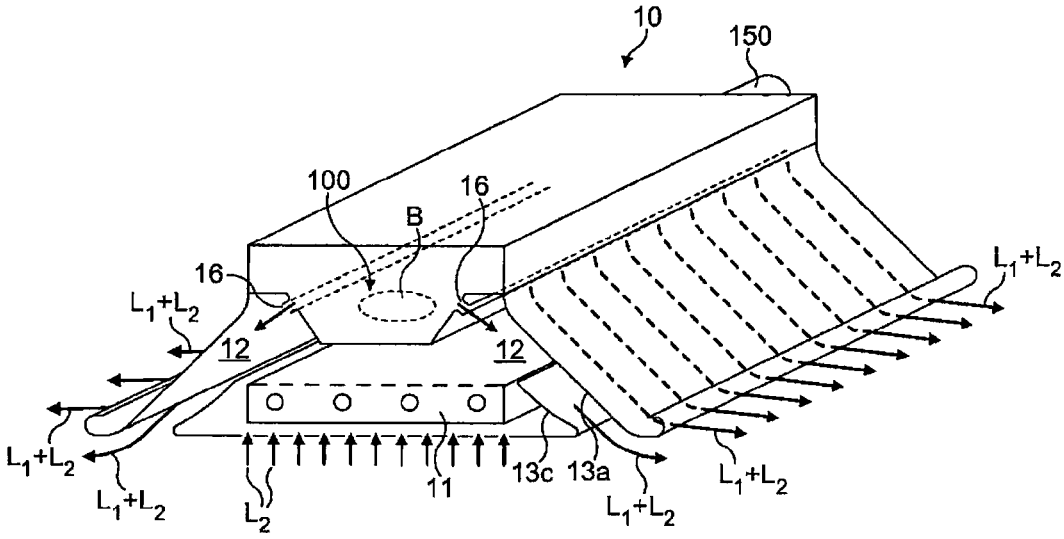
FIG. 3C shows a structure otherwise corresponding with the embodiment shown in FIGS. 3A and 3B, but with one elongate flow gap instead of the nozzles.

FIG. 3C shows a structure otherwise similar to the one in FIGS. 3A and 3B, but with an elongate flow gap 16 instead of the nozzles.

Figure 4A:
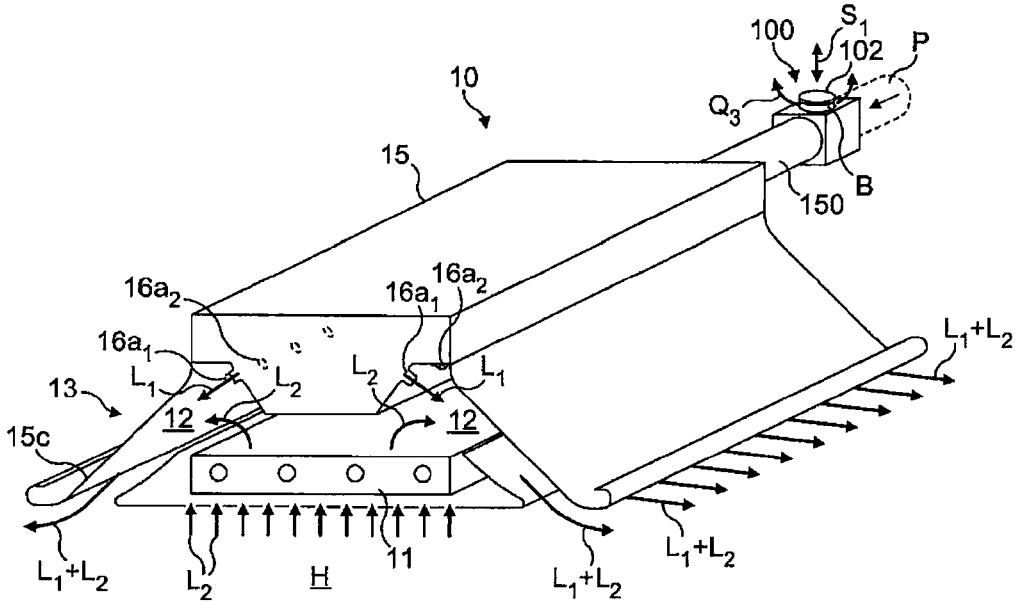
FIG. 4A shows an embodiment corresponding with FIGS. 3A, 3B, but in this device solution the regulator is fitted into an airflow supply tube fitting connected to an air chamber 15.

FIG. 4A shows a third advantageous embodiment of the invention, wherein a bypassing flow regulator 100 is fitted in a connecting tube fitting 150 leading into a supply air chamber 15. In the embodiment of FIG. 4A, the regulator 100 is shown as a mechanical regulating device of a corresponding kind as in connection with FIGS. 2A, 2B and 3A, 3B.

The embodiment in FIG. 4A shows a supply air terminal device 10. Room air is circulated from room H as shown by arrow $L_2$ through a heat exchanger 11. With the aid of a blowing fan $P_1$ (in FIG. 7) air is made to flow from outside into an air chamber 15 and further through nozzles 16$a_1$, 16$a_2$ . . . located therein (arrows $L_1$) into a mixing chamber 12. When arriving in the mixing chamber 12, the airflow $L_1$ induces a circulated airflow $L_2$ to flow through the heat exchanger 11. In heat exchanger 21, the circulated airflow $L_2$ is either cooled or heated. The airflows $L_1$ and $L_2$ are combined in mixing chamber 12 and the combined airflow $L_1+L_2$ is made to flow away from the location of the device, preferably horizontally in the direction of the suspended ceiling. In the embodiment of FIG. 4, the heat exchanger 11 is located centrally in the structure and the air chamber 15 is located above the heat exchanger when the device is at its place of operation on the suspended ceiling. The mixing chambers 12 are located at both sides of the heat exchanger 11 and the device is symmetrical in relation to a vertical central axis Y, which thus is the device's axis of symmetry. Thus, the presented device 10 is a structure which is open below and on the sides and closed at the top. The connecting tube fitting 150 leading into the supply air chamber 15 comprises a regulator 100 and by regulating this the airflow $Q_3$ can be conducted out of the connecting tube fitting into room H, and thus the nozzles 16$a_1$, 16$a_2$ . . . 16$a_n$ can be bypassed. A valve disc 102, which can be used to throttle the airflow $Q_3$, can be moved as shown by arrow $S_1$ towards opening B of air chamber 15 and away from the opening. When valve disc 102 is at the level of plate 15*a*, the airflow $Q_3$ is closed, and there is an airflow through the nozzles 16$a_1$, 16$a_2$ . . . 16$a_n$ only as an airflow Qs, whereby the total airflow $\Sigma Q=Q_3-Q_s$ will hereby be at its minimum value. Correspondingly, when the valve disc 102 is moved in such a way that the flow opening B is as open as possible and the valve disc 102 is as far away as possible from the air chamber's 15 plate 15*a*, the airflow $Q_3$ will be at its maximum value and then the total airflow $\Sigma Q=Q_3+Q_s$ will also be at its maximum value. It is hereby advantageous that a constant pressure exists in duct 150 and thus in chamber 15, whereby the device comprises a constant pressure regulator 500, as is presented in FIG. 7.

Figure 4B:
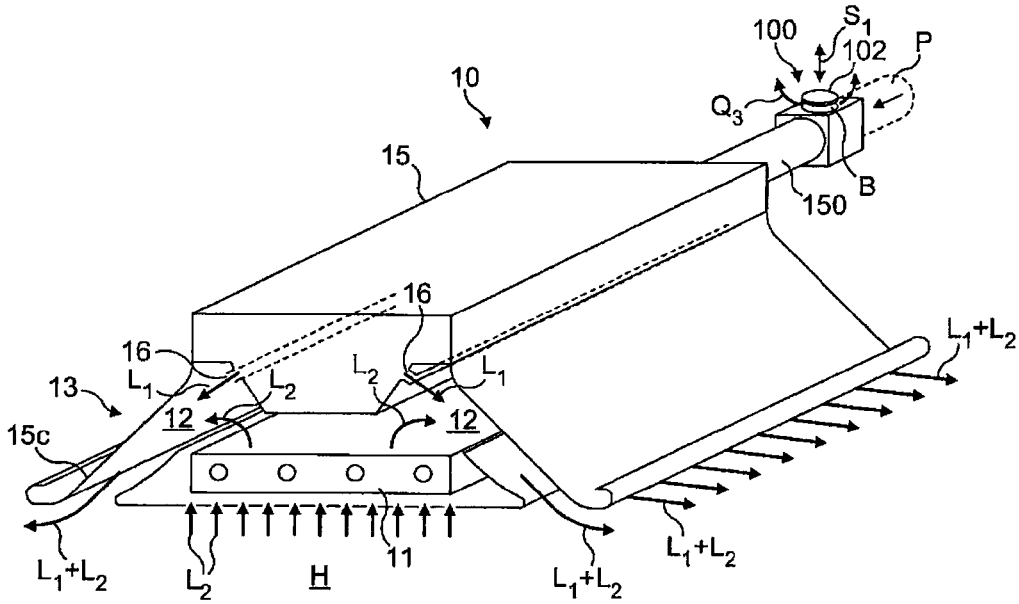
As shown in FIG. 4B, the nozzles are replaced by an elongate nozzle gap. The operation is otherwise similar to the embodiment shown in FIG. 4A.

As is shown in FIG. 4B, the nozzles 16$a_1$, 16$a_2$ . . . 16$a_n$ are replaced by an elongate nozzle gap 16. In other respects the operation is the same as in the embodiment shown in FIG. 4A.

Figure 5:
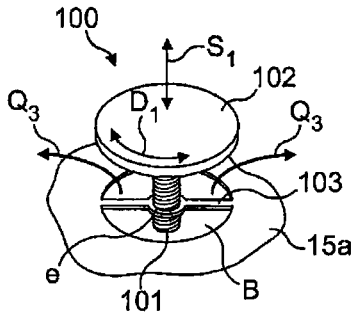
FIG. 5 is an illustrating view of the regulator's valve disc.

FIG. 5 shows a regulator 100 in connection with an air chamber 15 or a connecting tube fitting 150. A counter-fastening means 103 comprises a threaded hole e, into which a stem 101 can be screwed by its threads (arrow $D_1$) and thus moved in the direction of arrow $S_1$ in order to regulate the throttling of airflow $Q_3$.

Figure 6:
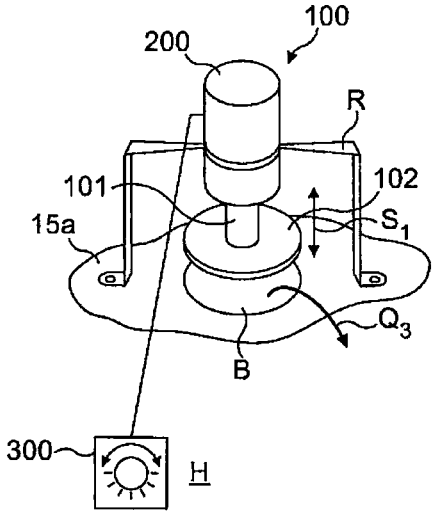
FIG. 6 is an illustrating view of an embodiment of the regulator, wherein the regulator comprises a remote-controlled actuator moving a closing part to close and open the flow.

FIG. 6 shows an embodiment of the regulator 100, where the regulator 100 comprises an actuator 200, which closes and opens a closing part 102, such as a valve disc, and which receives its control, for example, from the room space H. Actuator 200 may be an electrically working actuator. Thus it is possible from the room, where the supply air terminal device 10 is located, with a switch 300 to regulate the bypass flow $Q_3$ at each time progressively. Actuator 200 is suspended with a clamp R in air chamber 15. The linear direction of motion of valve disc 102 is indicated by arrows $S_1$ in the presentations of the figures.

Figure 7:
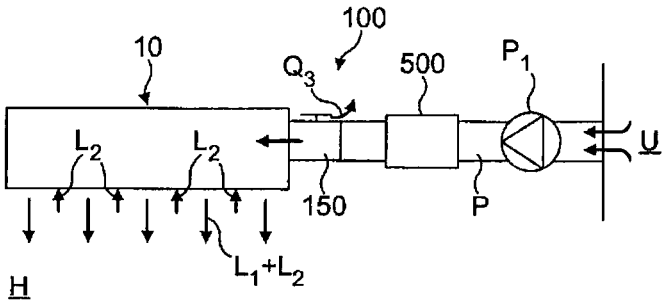
FIG. 7 shows the regulator 500 in principle as a constant pressure regulator, which regulates the desired pressure hp on the output side in the duct system 150 and in the air chamber 15.

FIG. 7 is a view in principle, wherein a connecting supply fitting 150 comprises in the same context a constant pressure regulator 500 in duct P on the pressure side of a blowing fan P1. The blowing fan P1 is adapted to draw air from outside U into duct P and further as a primary airflow $Q_s$, $Q_3$, which primary airflow $Q_s$, $Q_3$ is conducted into room H from a supply air chamber through nozzles 16$a_1$, 16$a_2$ . . . or through a nozzle gap 16 and a regulator 100. The constant pressure regulator 500 works to keep the pressure ΔP on the output side of the constant pressure regulator 500 (looking in the direction of travel of the airflow) at its controllable constant pressure value, that is, at a constant pressure value, irrespective at each time of the regulator's 100 opening and thus the air rate $Q_3$.

The invention claimed is:

1. Supply air terminal device (10) comprising:

a supply air chamber (15), two heat exchangers (11) at both sides of the supply air chamber (15), two mixing chambers (12) between the heat exchangers (11) and the supply air chamber (15), into which mixing chambers (12) a primary airflow ($L_1$) is conducted from the supply air chamber (15) through nozzles (16$a_1$, 16$a_2$ . . . 16$a_n$) or a flow gap (16), said primary airflow ($L_1$) inducing a circulated airflow ($L_2$) to flow from a room (H) through each heat exchanger (11) into each mixing chamber (12), said circulated airflow ($L_2$) arriving at each heat exchanger (11) from the side and being heated or cooled in the heat exchanger (11), a covering plate (13*b*) closing the supply air terminal device (10) from below, the supply air chamber (15), the heat exchangers (11), the mixing chambers (12), as well as the nozzles (16$a_1$, 16$a_2$ . . . 16$a_n$) or the flow gap (16) being located above the covering plate (13*b*), a discharge duct (A) being formed above each mixing chamber (12), said nozzles (16$a_1$, 16$a_2$ . . . 16$a_n$) or flow gap (16) directing the primary airflow ($L_1$) upwards, whereby a combined airflow ($L_1+L_2$) comprising the primary airflow ($L_1$) and the circulated airflow ($L_2$) is directed from each mixing chamber (12) through the discharge duct (A) obliquely upwards to the room (H) at a level of a ceiling (15*a*) of the supply air chamber (15), a regulator (100) fitted in the ceiling (15*a*) of the supply air chamber (15), said regulator (100) regulating a by-pass airflow ($Q_3$) flowing from the supply air chamber (15) to the room (H), said by-pass airflow ($Q_3$) bypassing the nozzles (16$a_1$, 16$a_2$ . . . 16$a_n$) or the flow gap (16), said regulator (100) making it possible, according to the purpose of the use of the room, to regulate the total airflow (ΣQ) of fresh primary air comprising the by-pass airflow ($Q_3$) through the regulator (100) and the primary airflow (Qs) through the nozzles (16$a_1$, 16$a_2$ . . . 16$a_n$) or the flow gap (16), the by-pass airflow ($Q_3$) being discharged from the supply air chamber (15) directly into the room to a space above the ceiling (15*a*) of the supply air chamber (15) and conducted further with the combined air flow ($L_1+L_2$) to the room (H), whereby said regulator (100) makes it possible, according to the purpose of the use of the room (H), to regulate the by-pass airflow ($Q_3$) flowing through the regulator (100) to the room (H) and in this way the total airflow (ΣQ) of fresh primary air flowing into the room (H), said total airflow of fresh primary air comprising the by-pass airflow ($Q_3$) flowing through the regulator (100) to the room (H) and the primary airflow (Qs) flowing through the nozzles (16$a_1$, 16$a_2$ . . . 16$a_n$) or the flow gap (16) to the room (H).

2. Supply air terminal device (10) according to claim 1, wherein the airflow rate ($Q_3$) made to flow through the regulator (100) is within a range of 0 . . . 50 l/s, and the airflow ($Q_s$) of the nozzles (16$a_1$, 16$a_2$ . . . 16$a_n$) or the flow gap (16) is within a range of 10 . . . 25 l/s, and the total airflow (ΣQ) conducted through the supply air terminal device (10) is within a range of 10 . . . 75 l/s.

3. Supply air terminal device (10) according to claim 1, wherein the flow ratio ($Q_3$/Qs) between the bypassing airflow ($Q_3$ l/s) past the nozzles (16$a_1$, 16$a_2$ . . . 16$a_n$) or the flow gap (16) conducted through the air regulator (100) and the airflow ($Q_s$ l/s) conducted through the nozzles (16$a_1$, 16$a_2$ . . . 16$a_n$) or the flow gap (16) is within a range of 0 . . . 5.

4. Supply air terminal device (10) according to claim 1, wherein the bypassing flow ($Q_3$) taking place through the regulator (100) can be regulated progressively.

5. Supply air terminal device (10) according to claim 1, wherein when the regulator (100) is in the fully closed position, there is no bypassing flow through the regulator (100), but there is only a flow (Qs) through the nozzles (16$a_1$, 16$a_2$ . . . ) or the flow gap (16), and hereby the total air rate ($\Sigma Q$) of the device is at its minimum, and when the regulator (100) is in the fully open position the maximum airflow ($Q_3$) is achieved through the regulator (100), and hereby the total air rate ($\Sigma Q$) of the device is also at its maximum.

6. Method for regulating the airflow rate in a supply air terminal device, which supply air terminal device (10) comprises:

a supply air chamber (15), two heat exchangers (11) at both sides of the air chamber (15), two mixing chambers (12) between the heat exchangers (11) and the supply air chamber (15), into which mixing chambers (12) a primary airflow ($L_1$) is conducted from the air supply chamber (15) through nozzles (16$a_1$, 16$a_2$ . . . 16$a_n$) or a flow gap (16), said primary airflow ($L_1$) inducing a circulated airflow ($L_2$) to flow from a room (H) through each heat exchanger (11) into each mixing chamber (12), said circulated airflow ($L_2$) arriving at each heat exchanger (11) from the side and being heated or cooled in the heat exchanger (11), a covering plate (13*b*) closing the supply air terminal device (10) from below, the supply air chamber (15), the heat exchangers (11), the mixing chambers (12) as well as the nozzles (16$a_1$, 16$a_2$ . . . 16$a_n$) or the flow gap (16) being located above the covering plate (13*b*), a discharge duct (A) being formed above each mixing chamber (12), said nozzles (16$a_1$, 16$a_2$ . . . 16$a_n$) or flow gap (16) directing the primary airflow ($L_1$) upwards, whereby a combined airflow ($L_1$+$L_2$) comprising the primary airflow ($L_1$) and the circulated airflow ($L_2$) is directed from each mixing chamber (12) through the discharge duct (A) obliquely upwards to the room (H), at a level of a ceiling (15*a*) of the supply air chamber (15), a regulator (100) fitted in the ceiling (15*a*) of the supply air chamber (15), said regulator (100) regulating a by-pass airflow ($Q_3$) flowing from the supply air chamber (15) to the room (H), said by-pass airflow ($Q_3$) bypassing the nozzles (16$a_1$, 16$a_2$ . . . 16$a_n$) or the flow gap (16), the by-pass airflow ($Q_3$) being discharged from the supply air chamber (15) directly into the room to a space above the ceiling (15*a*) of the supply air chamber (15) and conducted further with the combined air flow ($L_1$+$L_2$) to the room (H), regulating with said regulator (100) according to the purpose of the use of the room (H), the by-pass airflow ($Q_3$) flowing through the regulator (100) to the room (H) and in this way the total airflow ($\Sigma Q$) of fresh primary air flowing into the room (H), said total airflow ($\Sigma Q$) of fresh primary air comprising the by-pass airflow ($Q_3$) flowing through the regulator (100) to the room (H) and the primary airflow ($Q_s$) flowing through the nozzles (16$a_1$, 16$a_2$ . . . 16$a_n$) or the flow gap (16) to the room (H).

7. Method according to claim 6, wherein the airflow rate ($Q_3$) made to flow through the regulator (100) is within a range of 0 . . . 50 l/s and the airflow ($Q_s$) conducted through the nozzles (16$a_1$, 16$a_2$ . . . 16$a_n$) or the flow gap (16) is within a range of 10 . . . 25 l/s, and the total airflow ($\Sigma Q$) conducted through the supply air terminal device (10) is regulated within a range of 10 . . . 75 l/s.

8. Method according to claim 6, wherein in the method the flow ratio ($Q_3$/Qs) is regulated progressively within a range of 0 . . . 5.

9. Method according to any preceding claim 6, wherein the regulator (100) is remotely operated and it is controlled electrically, whereby the regulator (100) comprises an actuator (200) for moving a closing part (102) of the regulator (100) and for regulating the airflow rate ($Q_3$).

* * * * *